US008523302B2

(12) United States Patent
Shin et al.

(10) Patent No.: US 8,523,302 B2
(45) Date of Patent: Sep. 3, 2013

(54) DOOR HANDLE AND REFRIGERATOR HAVING THE SAME

(75) Inventors: Dong In Shin, Gwangju (KR); Jae Sek Oh, Kwangju (KR); Kyu Su Cho, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 25 days.

(21) Appl. No.: 12/932,819

(22) Filed: Mar. 3, 2011

(65) Prior Publication Data

US 2011/0273070 A1 Nov. 10, 2011

(30) Foreign Application Priority Data

May 7, 2010 (KR) ..... 10-2010-0042983

(51) Int. Cl.
*A47B 96/04* (2006.01)
*E05F 11/00* (2006.01)

(52) U.S. Cl.
USPC ..... 312/405; 49/276; 49/277; 49/278

(58) Field of Classification Search
USPC ..... 312/405, 244, 348.6, 296, 326–329; 16/412; 49/276, 277, 278, 364
See application file for complete search history.

(56) References Cited

U.S. PATENT DOCUMENTS 2,659,115 A * 11/1953 Anderson et al. ..... 49/277
3,982,801 A * 9/1976 Heidorn et al. ..... 312/306
5,740,587 A * 4/1998 Onai et al. ..... 16/412
5,906,423 A * 5/1999 Lyu ..... 312/405
5,908,228 A * 6/1999 Lee ..... 312/405
5,915,805 A * 6/1999 Lee ..... 312/405
7,984,955 B2 * 7/2011 Jung et al. ..... 312/405
2005/0160854 A1 * 7/2005 Rotter ..... 74/422
2008/0000052 A1 * 1/2008 Hong et al. ..... 16/382
2008/0163462 A1 * 7/2008 King ..... 16/412
2008/0211240 A1 * 9/2008 Mitchell ..... 292/220
2008/0282505 A1 * 11/2008 Kim ..... 16/412
2009/0179540 A1 * 7/2009 Seo ..... 312/405
2009/0205357 A1 * 8/2009 Lim et al. ..... 62/441
2011/0080083 A1 * 4/2011 Engel et al. ..... 312/405

FOREIGN PATENT DOCUMENTS

DE 20 2005 002 960 U1 6/2006
DE 102007018323 A1 * 12/2007
DE 10 2007 021 948 A1 1/2008
DE 102008026383 A1 * 12/2009

(Continued)

OTHER PUBLICATIONS

KR20080050672 Machine Translation.*

(Continued)

*Primary Examiner* — Janet M Wilkens
*Assistant Examiner* — Andrew Roersma
(74) *Attorney, Agent, or Firm* — Staas & Halsey LLP

(57) ABSTRACT

A refrigerator includes a refrigerator body, a door to open and close the front of the refrigerator body, and a door handle provided at one side of the door. The door handle includes a handle unit having a grip part to allow a user to grip the door handle, an actuating rod fixed inside the handle unit such that the actuating rod is moved along with the handle unit, a guide unit to guide movement of the actuating rod, a pusher configured to be advanced and retreated through movement relative to the actuating rod to push the refrigerator body, and a gear unit disposed between the actuating rod and the pusher such that the gear unit is engaged with the actuating rod and the pusher.

10 Claims, 9 Drawing Sheets

(56) References Cited

FOREIGN PATENT DOCUMENTS

| | | | | |
|---|---|---|---|---|
| EP | 1174668 | A1 | * | 1/2002 |
| EP | 1 249 567 | A1 | | 10/2002 |
| KR | 102008050672 | A | * | 6/2008 |
| WO | 2005/057106 | A1 | | 6/2005 |

OTHER PUBLICATIONS

European Search Report dated Aug. 22, 2011 in corresponding European Patent Application 11157566.8.

* cited by examiner

DOOR HANDLE AND REFRIGERATOR HAVING THE SAME

CROSS-REFERENCE TO RELATED APPLICATIONS

This application claims the benefit of Korean Patent Application No. 2010-0042983, filed on May 7, 2010 in the Korean Intellectual Property Office, the disclosure of which is incorporated herein by reference.

BACKGROUND

1. Field

Embodiments relate to refrigerator having a door opening device to push one side of a refrigerator body of a refrigerator according to manipulation of a door handle such that a door of the refrigerator is easily opened.

2. Description of the Related Art

Generally, a refrigerator is an apparatus that freshly stores various kinds of food in a refrigerated state or in a frozen state for a long period of time.

Cool air supplied into the refrigerator is generated by heat exchange of a refrigerant. The cool air is continuously supplied into the refrigerator through repetitive cycles of compression, condensation, expansion, and evaporation. The supplied cool air is uniformly dispersed in the refrigerator by convection to keep food at a predetermined temperature.

In recent years, demand for large-sized, high-quality refrigerators has gradually increased according to improvement in living standards, with the result that refrigerators having increased storage capacities have been increasingly popularized.

The storage space of each refrigerator is closed by a door. Based on how the door is opened and closed, the door may be classified as a rotary type door which is opened and closed by side-to-side rotation or up-and-down rotation or a drawer type door which is opened and closed by frontward-and-rearward movement.

In the door is mounted a door handle configured to be gripped by a user to easily open and close the door. Therefore, the door may be rotated or moved frontward and rearward while gripping the door handle to open and close the storage space.

In the conventional refrigerator, the door is rotated so as to open the storage space. To this end, the user rotates or pulls the door while gripping the door handle.

At this time, the user may apply force to open the door since the rear of the door is in tight contact with the refrigerator body via a gasket. That is, the user may apply force sufficient to separate the rear of the door from the refrigerator body so as to open the door.

Particularly in a case in which a large amount of food is stored at the rear of the rotary type door or in a case in which a large amount of food is stored in a drawer of the drawer type door, the door is very heavy, with the result that a large amount of force may be used to open the door.

According to the strength of the user, users may have difficulty applying force sufficient to open the door, which deteriorates user convenience.

SUMMARY

It is an aspect to provide a refrigerator having a door opening device to selectively push one side of a refrigerator body of a refrigerator according to manipulation of a door handle such that a door of the refrigerator is easily opened.

It is another aspect to provide a refrigerator having a door opening device to allow a user to easily open a door of the refrigerator, thereby improving user convenience.

Additional aspects will be set forth in part in the description which follows and, in part, will be apparent from the description, or may be learned by practice of the invention.

In accordance with one aspect, a refrigerator includes a refrigerator body, a door to open and close the front of the refrigerator body, and a door handle provided at one side of the door, wherein the door handle includes a handle unit having a grip part to allow a user to grip the door handle, an actuating rod fixed inside the handle unit such that the actuating rod is moved along with the handle unit, a guide unit to guide movement of the actuating rod, a pusher configured to be advanced and retreated through movement relative to the actuating rod to push one side of the refrigerator body, and a gear unit disposed between the actuating rod and the pusher such that the gear unit is engaged with the actuating rod and the pusher.

The door handle may further include a guide base at which the guide unit is fixedly located and a handle case coupled to the guide base to fixedly couple the door handle to one side of the door.

The gear unit may include a gear shaft located at the guide base in a supported state and a plurality of gears fixed to opposite ends of the gear shaft such that the gears are simultaneously rotated with the gear shaft.

The gears may be coupled to the opposite ends of the gear shaft in a symmetric manner.

The pusher may have a toothed part engaged with the gears of the gear unit.

The pusher may be selectively engaged with one of the gears.

The gears may include a first gear engaged with the actuating rod and a second gear engaged with the pusher.

The actuating rod may include at least one rod part fixed to the handle unit, the at least one rod part being disposed in the guide unit such that the at least one rod part is advanced and retreated in the frontward and rearward direction of the door, a toothed rod formed to be engaged with the gear unit in a protruding state, and a connection part to integrally interconnect the at least one rod part and the toothed rod.

The door handle may further include an elastic member disposed between the guide unit and the at least one rod part while surrounding the at least one rod part to apply elastic force to the actuating rod.

The guide unit may include a guide hole through which the at least one rod part is advanced and retreated.

The actuating rod may further include a first damper coupled to one end of the at least one rod part.

The refrigerator may further include a second damper disposed between the handle unit and the guide unit, the second damper being fixed to an inside of the handle unit or an outside of the guide unit.

The guide base may include a first guide groove to support the pusher such that the pusher is advanced and retreated in the frontward and rearward direction of the door.

The handle case may include a second guide groove to support the pusher such that the pusher is advanced and retreated in the frontward and rearward direction of the door.

In accordance with another aspect, a door handle, provided at one side of a door to open and close the front of a refrigerator body of a refrigerator, includes a handle unit having a grip part to allow a user to grip the door handle, actuating rods fixed to upper and lower parts of the handle unit inside the handle unit such that the actuating rods are moved along with the handle unit in the frontward and rearward direction of the door, a guide unit to guide movement of the actuating rods, a pusher to push one side of the refrigerator body, and a gear unit disposed between the actuating rods and the pusher, wherein the gear unit includes a plurality of gears engaged with the actuating rods and the pusher and a gear shaft having opposite ends to which the gears are fixed.

The door handle may further include a guide base at which the guide unit is fixedly located and a handle case coupled to the guide base and to one side of the door.

The gears may be coupled to the opposite ends of the gear shaft in a vertically symmetric manner.

The pusher may have a toothed part engaged with the gears of the gear unit.

The pusher may be selectively engaged with one of the gears.

The gears may include first gears engaged with the actuating rods and a second gear engaged with the pusher.

Each of the actuating rods may include at least one rod part fixed to the handle unit, the at least one rod part being disposed in the guide unit such that the at least one rod part is advanced and retreated in the frontward and rearward direction of the door, a toothed rod formed to be engaged with the gear unit in a protruding state, and a connection part to integrally interconnect the at least one rod part and the toothed rod.

The door handle may further include an elastic member disposed at the guide unit and the at least one rod part of each of the actuating rods while surrounding the at least one rod part of each of the actuating rods to apply elastic force to each of the actuating rods.

The guide unit may include a guide hole through which the at least one rod part is advanced and retreated.

Each of the actuating rods may further include a first damper coupled to one end of the at least one rod part.

The door handle may further include a second damper disposed between the handle unit and the guide unit, the second damper being fixed to an inside of the handle unit or an outside of the guide unit.

The guide base may include a first guide groove to support the pusher such that the pusher is advanced and retreated in the frontward and rearward direction of the door.

The handle case may include a second guide groove to support the pusher such that the pusher is advanced and retreated in the frontward and rearward direction of the door.

In accordance with a further aspect, a refrigerator door to open and close the front of a refrigerator body of a refrigerator is provided at one side thereof with a door opening device including a handle unit having a grip part to allow a user to pull the door opening device while gripping the door opening device, a plurality of actuating rods fixed to upper and lower parts of the handle unit such that the actuating rods are moved along with the handle unit in a frontward and rearward direction of the door, a plurality of guide units to guide movement of the actuating rods, a guide base at which the guide units are fixedly located, a handle case coupled to the guide base to fixedly couple the door opening device to one side of the door, a pusher configured to be advanced and retreated through movement relative to the actuating rods to push one side of the refrigerator body, and a gear unit disposed between the actuating rods and the pusher, wherein the gear unit includes a plurality of gears engaged with the actuating rods and the pusher and a gear shaft having opposite ends to which the gears are fixed.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
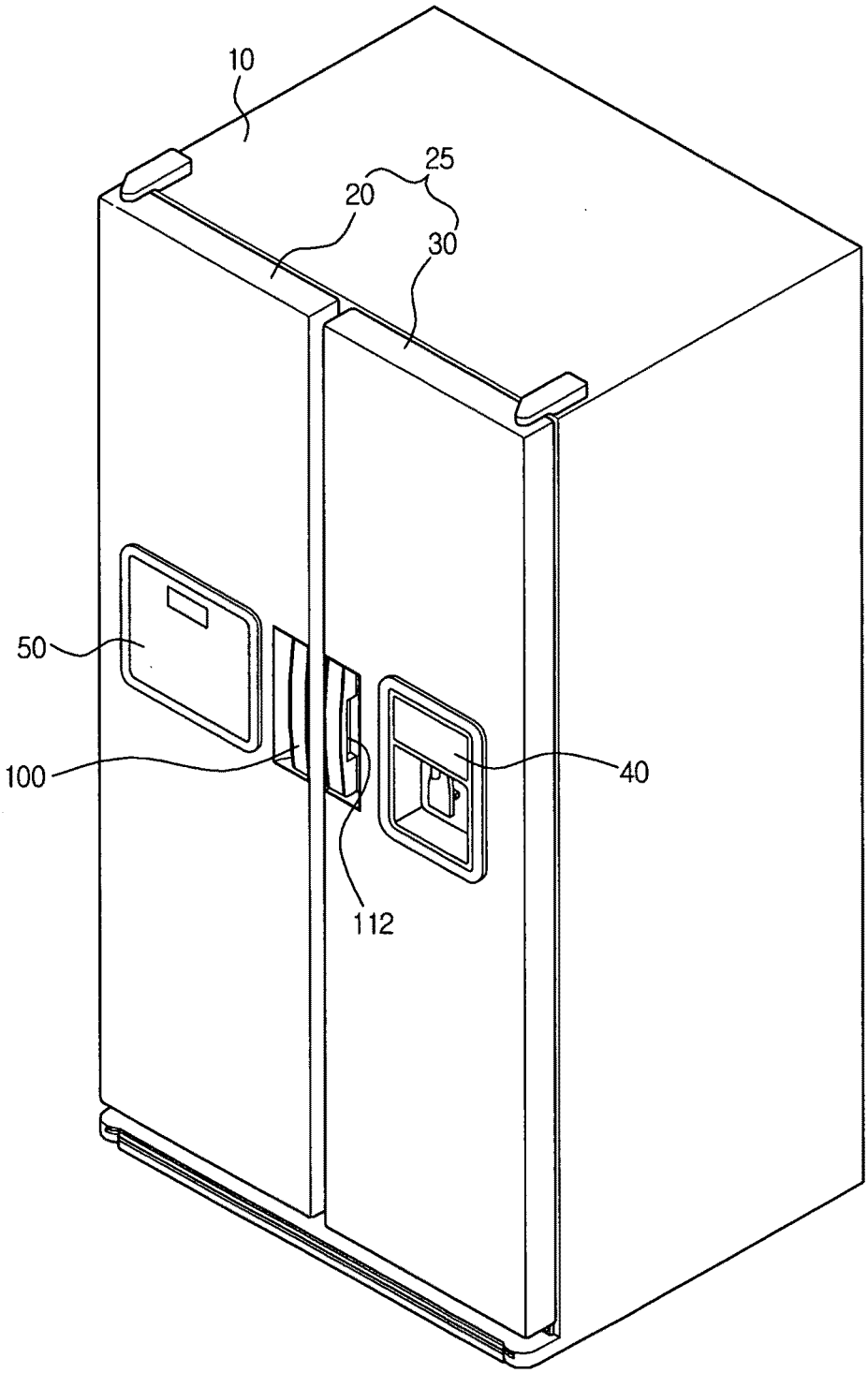
FIG. 1 is a perspective view illustrating the external appearance of a refrigerator having door handles according to an embodiment.

Reference will now be made in detail to the embodiments, examples of which are illustrated in the accompanying drawings, wherein like reference numerals refer to like elements throughout.

FIG. 1 is a perspective view illustrating the external appearance of a refrigerator having door handles according to an embodiment.

As shown in FIG. 1, the refrigerator has a refrigerator body 10 configured approximately in the shape of a rectangular parallelepiped. In the refrigerator body 10 is defined a storage chamber including a freezing chamber and a refrigerating chamber.

The front of the storage chamber is open, and the open front of the storage chamber is closed by a refrigerator door 25 including a refrigerating chamber door 20 and a freezing chamber door 30. The refrigerating chamber door 20 and the freezing chamber door 30 are hingedly mounted at left and right sides of the refrigerator body 10, respectively.

At the front of the freezing chamber door 30 is provided a dispenser 40 to dispense purified water or ice as needed. At the front of the refrigerating chamber door 20 is mounted a home bar 50 to allow a user to take food out of the refrigerating chamber without opening the refrigerating chamber door 20.

A door handle 100 is mounted at the front of the refrigerating chamber door 20. Another door handle 100 is mounted at the front of the freezing chamber door 30. Each door handle 100 is gripped by a user upon opening the refrigerator door 25. Specifically, one of the door handles 100 is mounted at the right side of the front of the refrigerating chamber door 20. Also, the other door handle 100 is mounted at the left side of the front of the freezing chamber door 30.

Each door handle 100 is mounted at the refrigerator door 25 at a height at which a user may easily grip each door handle 100.

Also, each door handle 100 has a length corresponding to the length of the dispenser 40 or the home bar 50. Each door handle 100 is spaced apart from the front of the refrigerator door 25 frontward such that a user may easily grip and manipulate each door handle 100.

The door handle 100 mounted at the refrigerating chamber door 20 and the door handle 100 mounted at the freezing chamber door 30 have the same structure and differ only in position. Hereinafter, therefore, a description will be given based on the door handle 100 mounted at the refrigerating chamber door 20.

Figure 2:
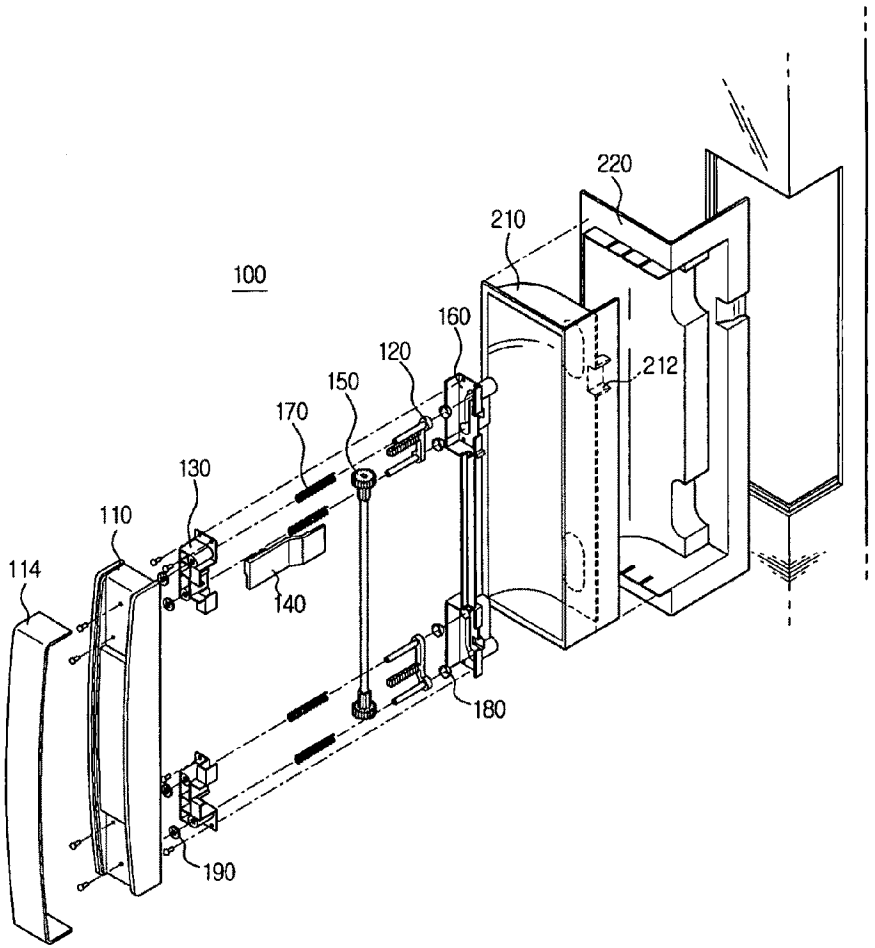
FIG. 2 is an exploded perspective view of the door handle.
Figure 3:
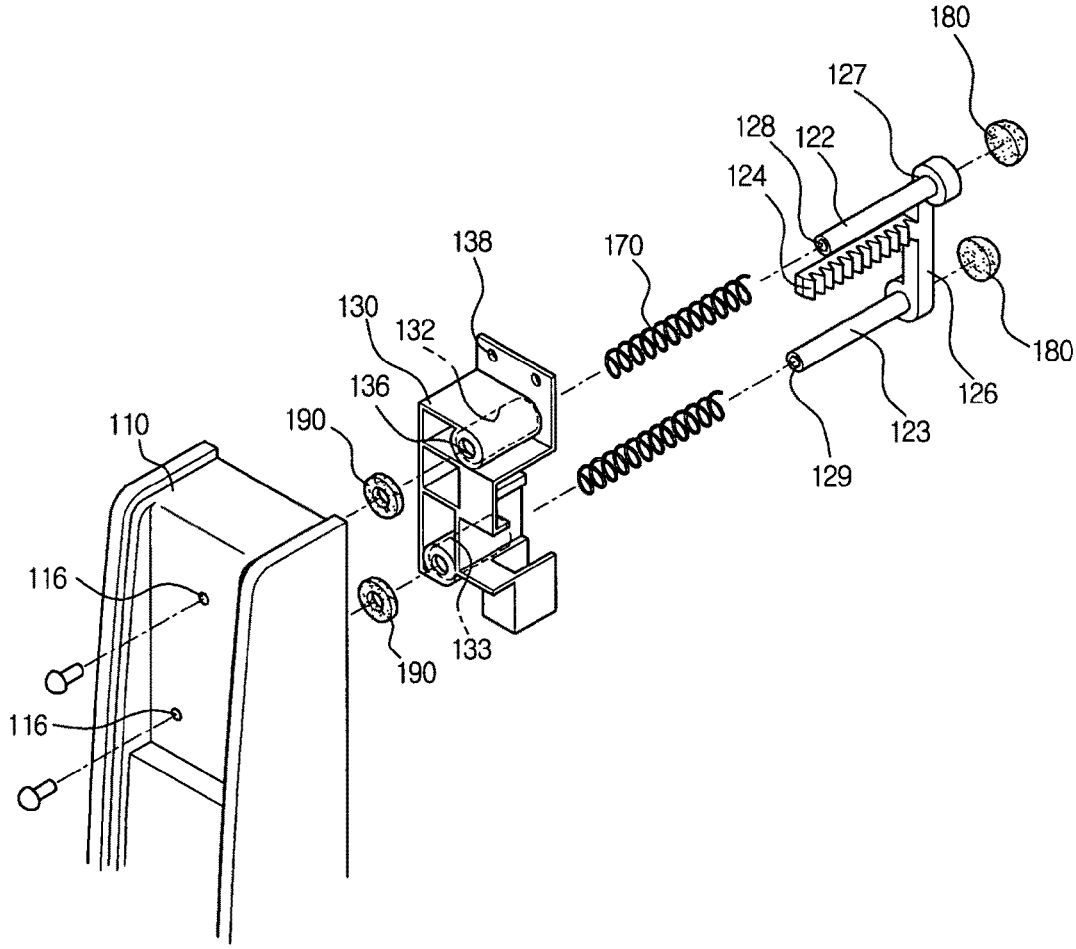
FIG. 3 is a perspective view illustrating a coupling structure of a handle unit, an actuating rod, a guide unit, and elastic members of the door handle.
Figure 4:
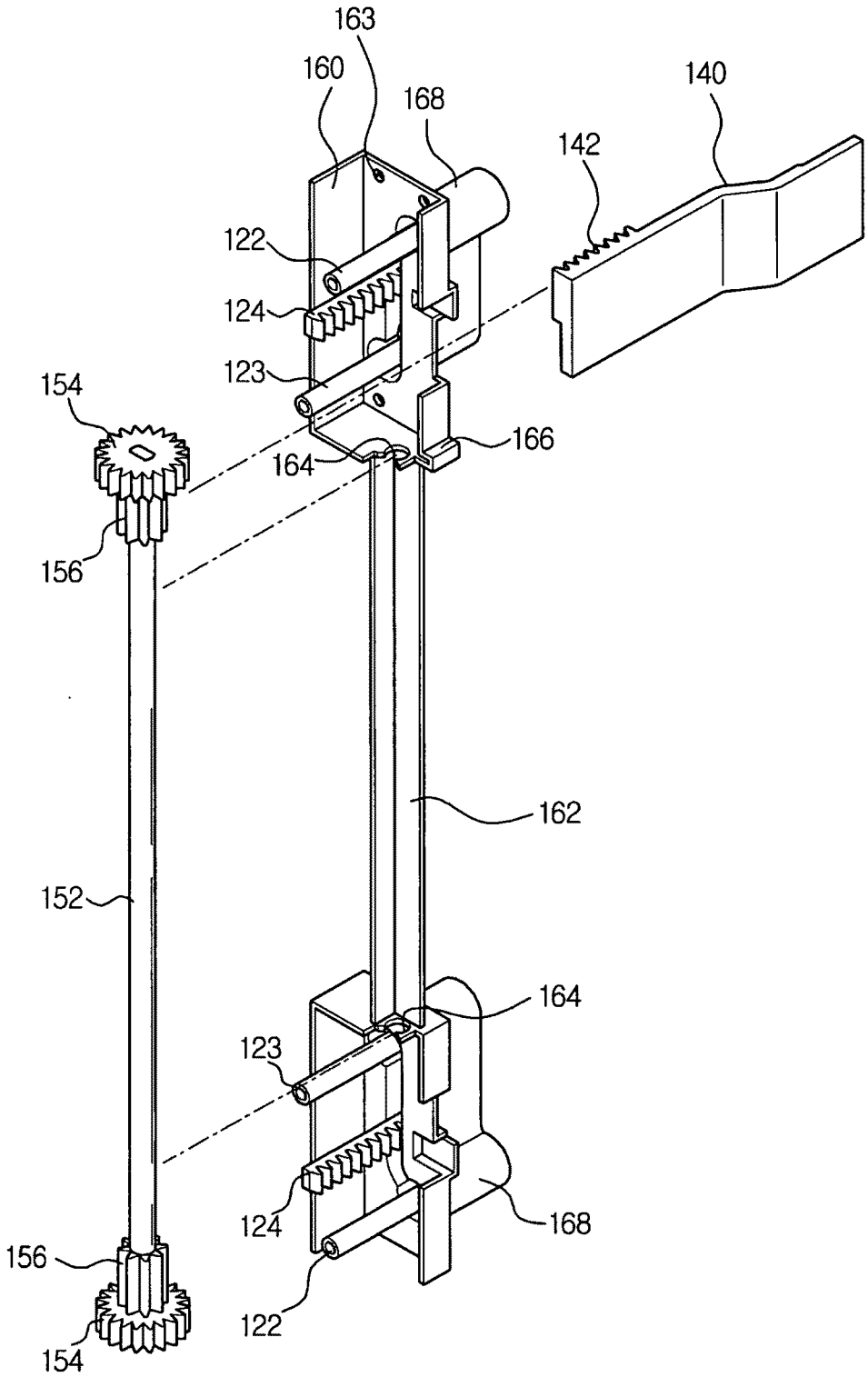
FIG. 4 is a perspective view illustrating a coupling structure of a gear unit, a guide base, and a pusher of the door handle.
Figure 5:
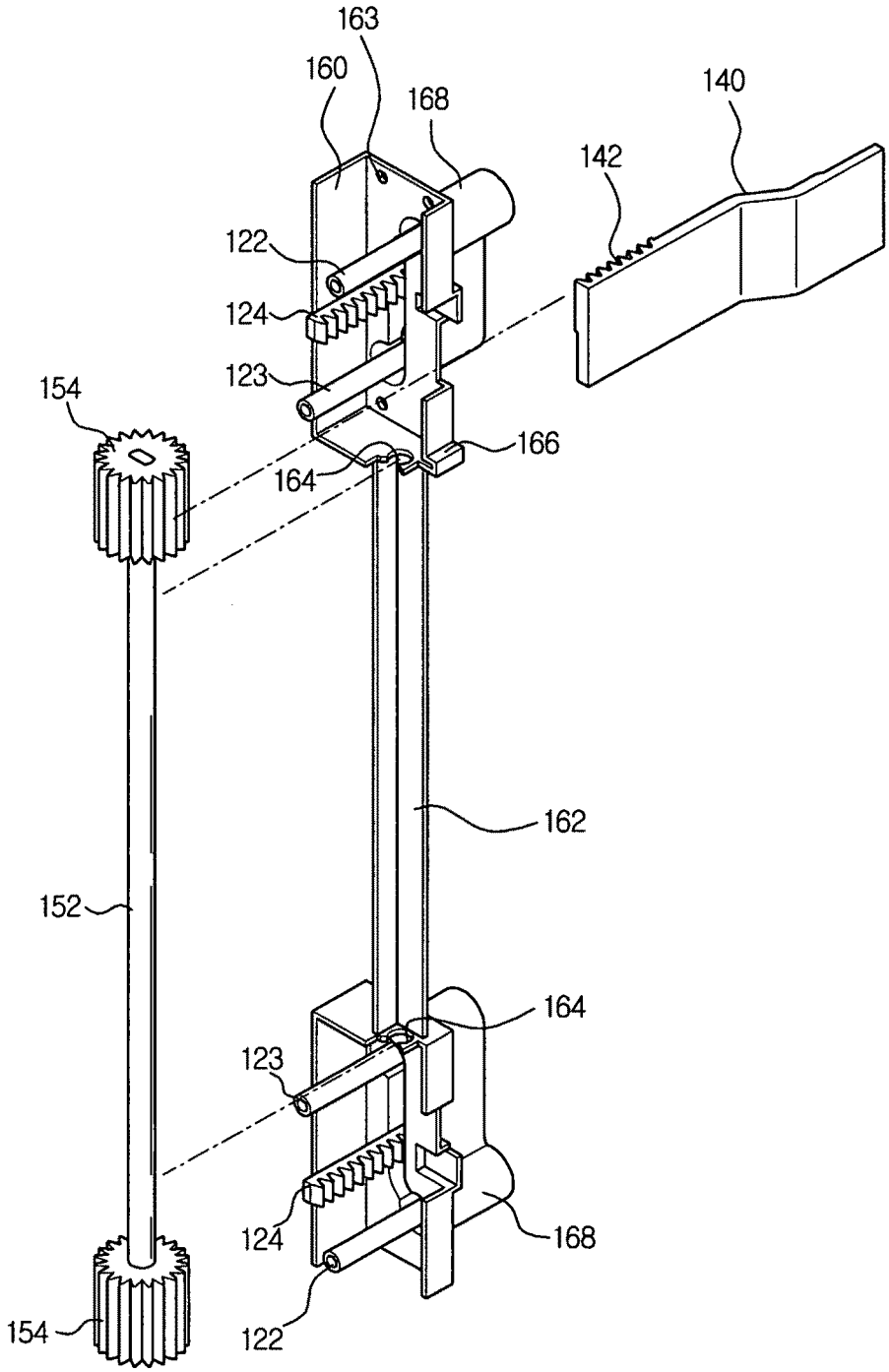
FIG. 5 is a perspective view illustrating a coupling structure of a gear unit, a guide base, and a pusher of a door handle according to another embodiment.
Figure 6:
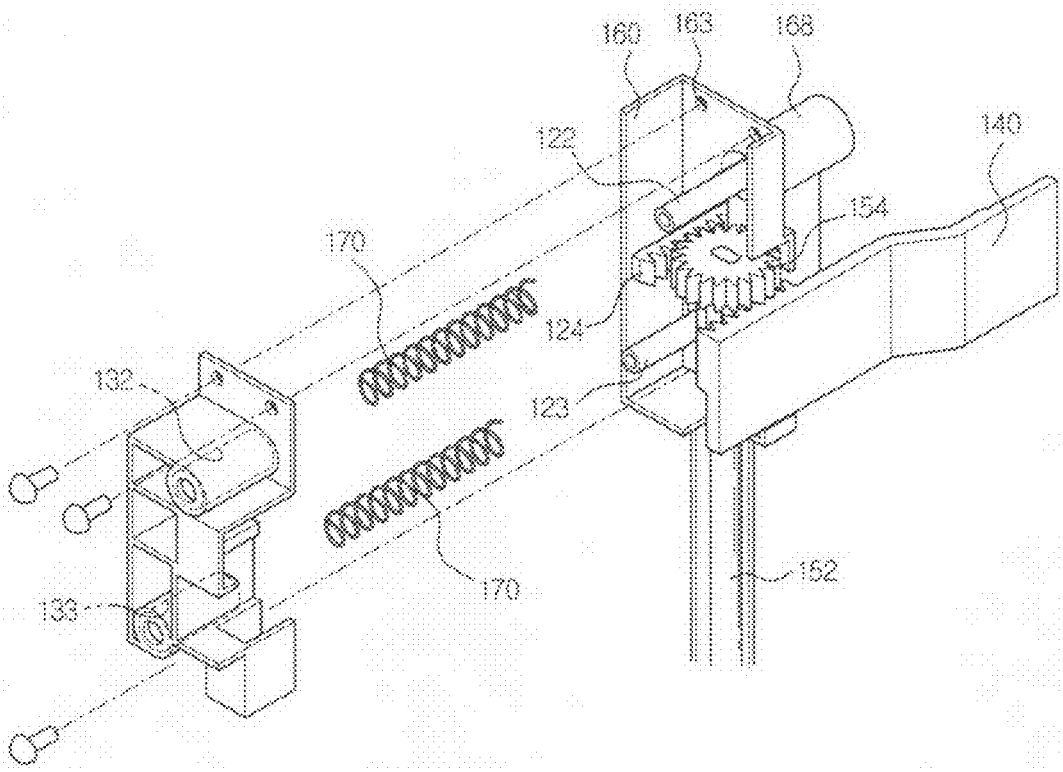
FIG. 6 is a perspective view illustrating a coupling structure of the guide unit and the guide base of the door handle.
Figure 7:
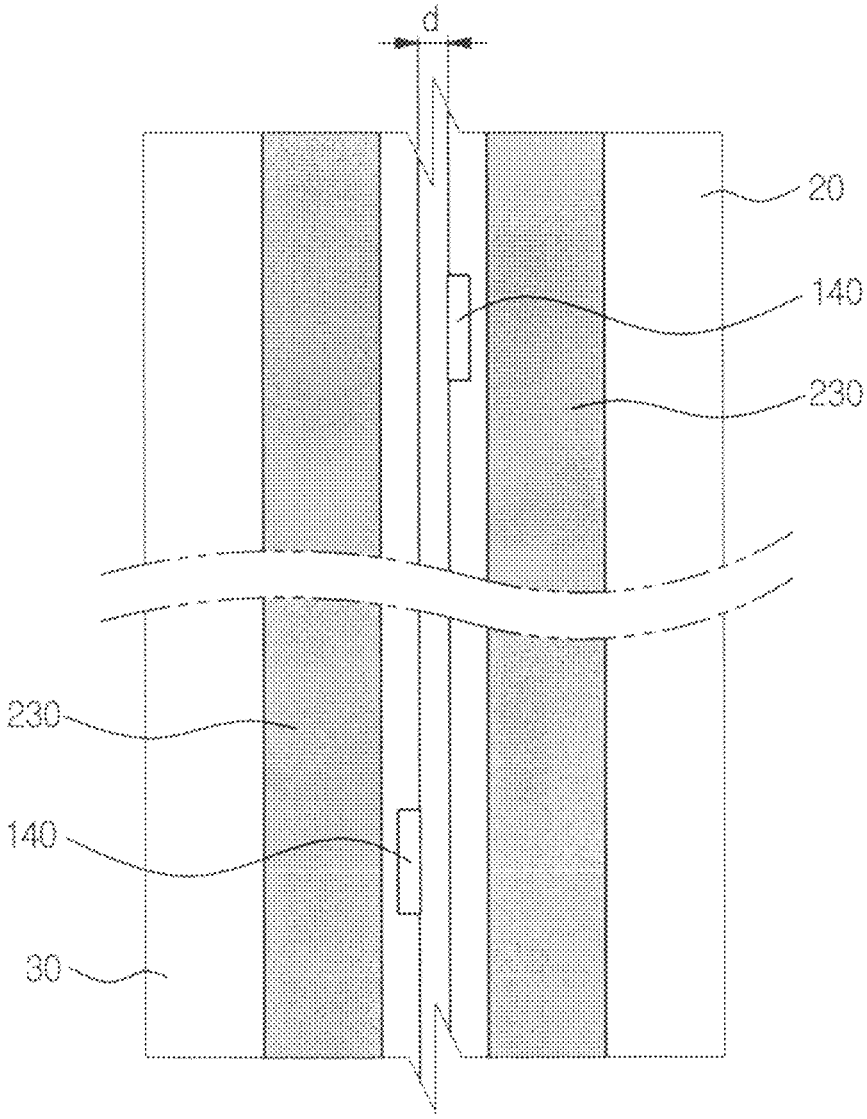
FIG. 7 is a front view of a refrigerator door in which the door handle is mounted when viewed from the inside.

FIG. 2 is an exploded perspective view of the door handle, FIG. 3 is a perspective view illustrating a coupling structure of a handle unit, an actuating rod, a guide unit, and elastic members of the door handle, FIG. 4 is a perspective view illustrating a coupling structure of a gear unit, a guide base, and a pusher of the door handle, FIG. 5 is a perspective view illustrating a coupling structure of a gear unit, a guide base, and a pusher of a door handle according to another embodiment of the present invention, FIG. 6 is a perspective view illustrating a coupling structure of the guide unit and the guide base of the door handle, and FIG. 7 is a front view of a refrigerator door in which the door handle is mounted when viewed from the inside.

As shown in FIGS. 2 to 7, the door handle 100 includes a handle unit 110, actuating rods 120, guide units 130, a pusher 140, a gear unit 150, a guide base 160, elastic members 170, and a handle case 210.

The handle unit 110 is gripped by a user during manipulation of the door handle 100. The handle unit 110 is configured approximately in a rectangular shape. The handle unit 110 includes a grip part 112 (see FIG. 1) to allow the user to easily grip the door handle 100. While griping the grip part 112 of the handle unit 110, the user may pull the door handle 100.

The handle unit 110 is hollowed to define an inner space in which the actuating rods 120 and the guide units 130 are disposed.

In the inner space of the handle unit 110 is fixedly disposed a portion of each actuating rod 120. As shown in FIG. 3, each actuating rod 120 is fixed to the handle unit 110 by threadedly inserting screws into coupling holes 128 and 129 formed at first and second rods 122 and 123 of each actuating rod 120 through first screw holes 116 formed at the handle unit 110.

In FIG. 3, each actuating rod 120 is fixed to the handle unit 110 in a screw coupling manner. Alternatively, each actuating rod 120 may be fixed to the handle unit 110 using a bonding agent, or a receiving part (not shown) may be formed in the inner space of the handle unit 110 such that each actuating rod 120 is fitted into the receiving part.

Each actuating rod 120, fixedly coupled to the handle unit 110, includes a first rod 122, a second rod 123, a toothed rod 124, and a connection part 126.

The first rod 122 and the second rod 123 extend from the connection part 126 by a predetermined length. As previously described, the coupling holes 128 and 129 are formed at ends of the first rod 122 and the second rod 123 such that the first rod 122 and the second rod 123 are coupled into the inner space of the handle unit through the coupling holes 128 and 129.

The first rod 122 and the second rod 123 are received in guide holes 132 and 133 formed at the guide unit 130 such that the first rod 122 and the second rod 123 are reciprocated in the frontward and rearward direction of the refrigerator door 25.

The toothed rod 124 extends from the connection part 126 by a predetermined length. The toothed rod 124 is disposed between the first rod 122 and the second rod 123. The toothed rod 124 is engaged with a second gear 156 formed at the gear unit 150. The toothed rod 124 may be configured in a toothed shape corresponding to the second gear 156 such that each actuating rod 120 is moved relative to the gear unit 150.

The connection part 126 interconnects the first rod 122, the second rod 123, and the toothed rod 124. The connection part 126 is curved downward to have a predetermined curvature.

Sides of the connection part 126 from which the first rod 122 and the second rod 123 extend constitute support parts 127, which are formed in the shape of a circle having a greater diameter than the first rod 122 and the second rod 123 to support the elastic members 170 in the direction in which the elastic members 170 are opposite to each guide unit 120.

Also, first dampers 180 are provided at sides of the connection part 126 opposite to the direction in which the first rod 122 and the second rod 123 extend.

The first dampers 180 minimize noise and impact which may be generated when each actuating rod 120 collides with the front of the refrigerator door 25 during reciprocating movement in the frontward and rearward direction of the refrigerator door 25.

Each guide unit 130, which receives the first rod 122 and the second rod 123 such that each actuating rod 120 is reciprocated in the frontward and rearward direction of the refrigerator door 25, includes guide holes 132 and 133, support protrusions 136, and second screw holes 138.

The guide holes 132 and 133 are provided at positions of each guide unit 130 corresponding to the first rod 122 and the second rod 123 of each actuating rod 120. The guide holes 132 and 133 are depressed approximately in the sectional shape of a circle to receive the elastic members 170 while the first rod 122 and the second rod 123 are inserted through the guide holes 132 and 133.

The support protrusions 136 perform the same function as the support parts 127 of each actuating rod 120. When one end of each elastic member 170 is supported by a corresponding one of the support parts 127 of each actuating rod 120, the other end of each elastic member 170 is supported by a corresponding one of the support protrusions 136 of each guide unit 130. In a state in which the opposite ends of each elastic member 170 are supported by the corresponding support part 127 and the corresponding support protrusion 136, each elastic member 170 applies elastic force to the corresponding support part 127 and the corresponding support protrusion 136 in the direction in which each elastic member 170 stretches.

A second damper 190 may be provided at the reverse side of each support protrusion 136, i.e., at the side of each support protrusion 136 opposite to the side at which the corresponding elastic member 170 is supported.

The second dampers 190 minimize noise and impact which may be generated when the handle unit 110 collides with each guide unit 130 during reciprocating movement in the frontward and rearward direction of the refrigerator door 25.

The second dampers 190 may not be provided at the reverse sides of the support protrusions 136 of each guide unit 130. As long as the second dampers 190 are located between the handle unit 110 and the guide unit, the second dampers 190 may be fixed to the reverse sides of the support protrusions 136 of each guide unit 130 or to the inside of the handle unit 110.

The second screw holes 138 are configured to fixedly locate each guide unit 130 at the guide base 160 along with fixing holes 163 formed at the guide base 160.

In FIG. 6, each guide unit 130 is fixed to the guide base 160 in a screw coupling manner. Alternatively, each guide unit 130 may be fixed to the guide base 160 using a bonding agent.

The guide base 160, at which each guide unit 130 is fixedly located, includes a base connection part 162, fixing holes 163, gear shaft location slots 164, a first guide groove 166, and guide ribs 168.

Each guide unit 130 is fixed to the guide base 160 by threadedly inserting screws into the fixing holes 163 of the guide base 160 through the second screw holes 138 formed at each guide unit 130.

The gear shaft location slots 164 are configured such that a gear shaft 152 of the gear unit 150 is located in the gear shaft location slots 164. Each of the gear shaft location slots 164 is configured in the shape of a circle having a diameter slightly greater than the gear shaft 152, which is configured in the shape of a rod. One side of each gear shaft location slot 164 is open such that the gear shaft 152 is inserted into each gear shaft location slot 164. Consequently, the gear shaft 152 is rotated in the gear shaft location slots 164 of the guide base 160.

The guide ribs 168 protrude from positions of the guide base 160 corresponding to the guide holes 132 and 133 of each guide unit 130.

The guide ribs 168 are hollowed in a shape corresponding to each actuating rod 120 such that each actuating rod 120 is reciprocated through the guide ribs 168 in the frontward and rearward direction of the refrigerator door 25.

The first guide groove 166 is provided at one side of the guide base 160 in an open state.

The first guide groove 166 supports the pusher 140 such that the pusher 140 is reciprocated in the frontward and rearward direction of the refrigerator door 25 when the pusher 140 is moved relative to the handle unit 110 and each actuating rod 120 in the direction opposite to the handle unit 110 and each actuating rod 120.

As shown in FIGS. 2 and 4, the base connection part 162 vertically interconnects upper and lower parts of the guide base 160.

The gear unit 150, disposed between the actuating rods 120 and the pusher 140 to move the actuating rods 120 and the pusher 140 relative to each other in opposite directions, includes a gear shaft 152, first gears 154, and second gears 156.

The gear shaft 152 is configured in the shape of a rod. The gear shaft 152 extends vertically by a predetermined length. The first gears 154 and the second gears 156 are connected to the gear shaft 152 such that the first gears 154 and the second gears 156 are simultaneously rotated about a single center.

Also, the gear shaft 152 is rotatably located in the gear shaft location slots 164 of the guide base 160.

The first gears 154 are fixed to opposite ends of the gear shaft 152. The first gears 154 are configured generally in the shape of a spur gear. Each of the first gears 154 is engaged with the corresponding toothed rod 124 of the actuating rod 160.

The second gears 156 are integrally formed with the first gears 154. The second gears 156 are coupled to the gear shaft 152. One of the second gears 156 is configured in a shape corresponding to a gear part 142 formed at the pusher 140 such that the second gear 156 is engaged with the gear part 142.

The first gears 154 and the second gears 156 are located at the opposite ends of the gear shaft 152 in a vertically symmetric manner.

With the structure and coupling relationship of the gear unit 150, force applied from a user to the handle unit 110 is sequentially transmitted to the actuating rod 120, the first gears 154, the second gears 156, and the pusher 140.

The pusher 140 is advanced and retreated through movement of the pusher 140 relative to the corresponding actuating rod 120 to push one side of the refrigerator body 10. The pusher 140 includes a toothed part 142.

The toothed part 142 is engaged with the corresponding second gear 156 of the gear unit 150 such that the pusher 140 is advanced and retreated.

The pusher 140 is bent outward to avoid interference with a gasket 230 mounted inside the refrigerator door 25 (see FIG. 7).

As previously described, the upper and lower parts of the guide base 160 are vertically connected to each other via the base connection part 162, the gear shaft 152 is rotatably located in the gear shaft location slots 164 provided at the upper and lower parts of the guide base 160, and the first gears 154 and the second gears 156 are coupled to the opposite ends of the gear shaft 152 in a vertically symmetric manner.

The pusher 140 may be selectively coupled to one of the second gears 156 coupled to the gear shaft 152 in the vertically symmetric manner.

As shown in FIG. 7, therefore, when a pair of door handles 100 is mounted at opposite sides of the refrigerator door 25, a pusher 140 is mounted in the upper side of the door handle 100 mounted in the refrigerating chamber door 20 and a pusher 140 is mounted in the lower side of the door handle 100 mounted in the freezing chamber door 30, so as to reduce the distance d between the refrigerating chamber door 20 and the freezing chamber door 30.

The pusher 140 selectively coupled to the corresponding second gear 156 is advanced and retreated while being supported by the first guide groove 166 of the guide base 160 and a second guide groove 212 formed at the handle case 210.

As shown in FIG. 5, the gear unit 150 may include a gear shaft 152 and first gears 154. That is, the first gears 154, coupled to the gear shaft 152, may be configured to be simultaneously engaged with the toothed rod 124 and the toothed part 142.

The handle case 210 and a case cover 220 are coupled to the refrigerator door 25 in a state in which the guide base 160 is fixed inside the handle case 210 and the case cover 220.

A cover member 114 is coupled to the outside of the handle unit 110. The cover member 114 may be designed to provide an aesthetically pleasing appearance.

In conclusion, the respective components constituting the door handle 100 are coupled as follows. The guide units 130 are fixed to the handle case 210 in a state in which the guide units 130 are coupled to the guide base 160, and the handle case 210 is fixed to the refrigerator door 25. That is, the guide units 130, the guide base 160, and the handle case 210 are fixed to the refrigerator door 25.

An actuating rod 120 is fixed to the upper part of the handle unit 110, and another actuating rod 120 is fixed to the lower part of the handle unit 110. The toothed rods 124 of the actuating rods 120 are disposed to be engaged with the first gears 154 coupled to the opposite ends of the gear shaft 152 such that the actuating rods 120 are advanced and retreated along with the handle unit 110 when a user applies force to the handle unit 110.

At this time, the advancing and retreating movement of the actuating rods 120 are guided along the guide holes 132 and 133 of the guide units 130 and the guide ribs 168 of the guide base 160.

The elastic members 170 are located between the support parts 127 of the actuating rods 120 and the support protrusions 132 of the guide units 130 in a compressed state.

The gear unit 150 is located in the gear shaft location slots 164 of the guide base 160 in a state in which the gear unit 150 is engaged with the actuating rods 120 and the pusher 140 such that the actuating rods 120 and the pusher 140 are moved relative to each other.

The first gears 154 and the second gears 156 constituting the gear unit 150 are connected to the opposite ends of the gear shaft 152 such that the first gears 154 and the second gears 156 are operated together.

The pusher 140 is selectively coupled to the second gear 156 located at the upper end or the lower end of the gear shaft 152.

Hereinafter, a principle of opening the refrigerator door to which the door handle 100 with the above-stated construction will be described.

Figure 8:
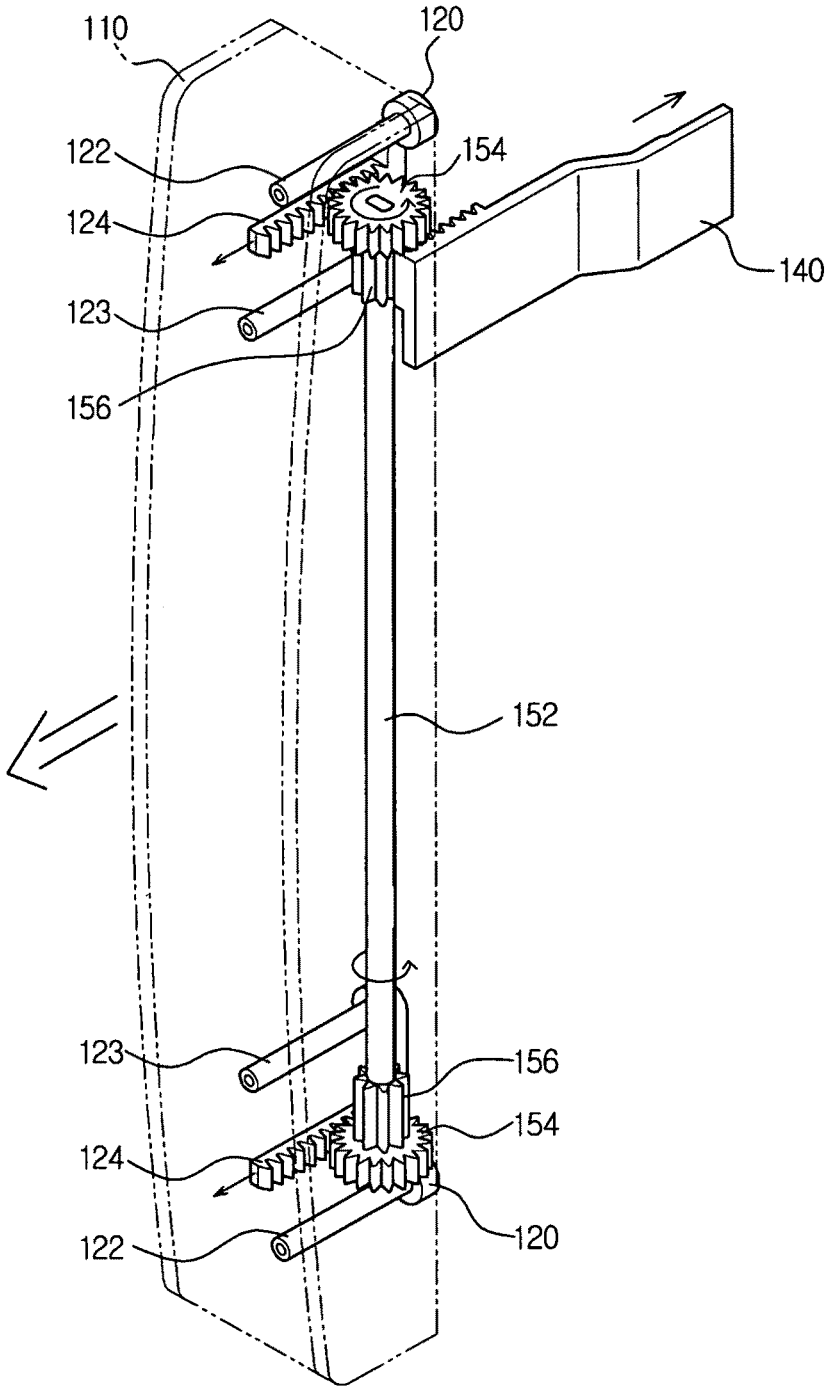
FIG. 8 is a sectional view illustrating the operating principle of the door handle.
Figure 9:
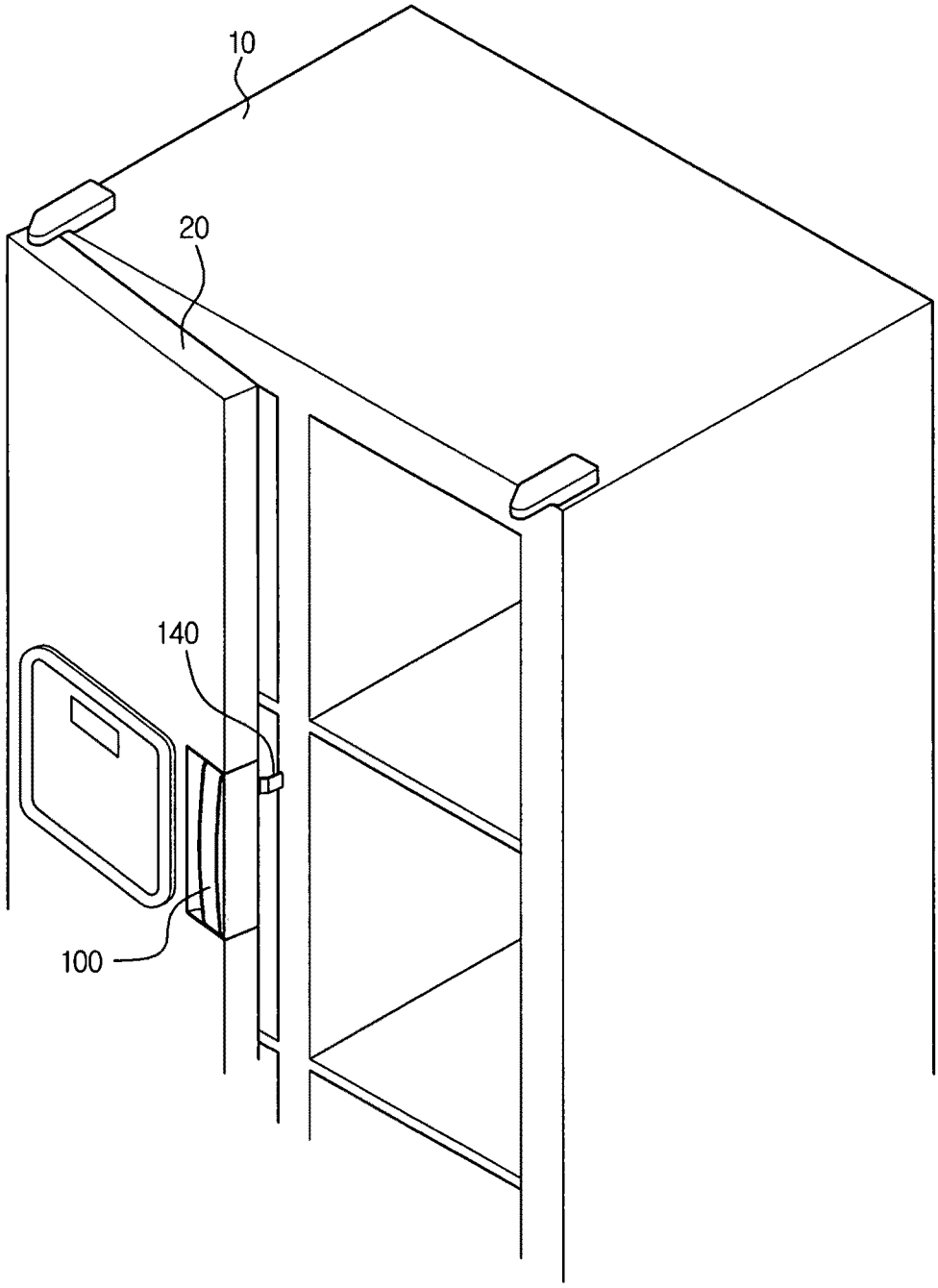
FIG. 9 is a perspective view illustrating an open state of the refrigerator door in which the door handle is mounted.

FIG. 8 is a sectional view illustrating the operating principle of the door handle, and FIG. 9 is a perspective view illustrating an open state of the refrigerator door in which the door handle is mounted.

Generally, the refrigerating chamber door 20 is in contact with one side of the refrigerator body 10 to close the storage chamber. At this time, the inside of the handle unit 110 is in contact with the second dampers 190 coupled to the guide units 130.

When a user pulls the handle unit 110 in the direction in which the handle unit 110 moves away from the refrigerating chamber door 20 (hereinafter, referred to as frontward and the opposite direction is referred to as rearward), as shown in FIG. 8, while gripping the grip part 112 of the handle unit 110 to open the refrigerating chamber door 20 in the above-stated state, the actuating rods 120 fixedly connected to the handle unit 110 are moved frontward, with the result that the toothed rods 124 of the respective actuating rods 120 are moved frontward.

The first gears 154 of the gear unit 150 engaged with the corresponding toothed rods 124 are rotated in the direction, as shown in FIG. 8, with the result that the gear shaft 152 and the second gears 156 connected to the first gears 154 are rotated in the same direction as the first gears 154.

The pusher 140, engaged with one of the second gears 156, is moved rearward, i.e., toward the refrigerator body 10, by the toothed part 142 to which rotational force from the corresponding second gear 156 is transmitted.

While moving toward the refrigerator body 10, the pusher 140 protrudes from the handle case 210 and the case cover 220 to push one side of the refrigerator body 10 as shown in FIG. 9, with the result that the refrigerating chamber door 20 is opened according to a principle of action and reaction.

On the other hand, when the user removes the force applied to the handle unit 110 in a state in which the refrigerating chamber door 20 is open, the actuating rods 120 are moved rearward by the elastic members 170 applying elastic force to the support parts 127 of the respective actuating rods 120 in the direction in which elastic members 170 stretch, with the result that the handle unit 110 connected to the actuating rods 120 is moved rearward to the original position thereof.

As is apparent from the above description, when the door handle is pulled frontward to open the refrigerator door, the pusher pushes one side of the refrigerator body in proportion to force pulling the door handle through relative movement of the actuating rods, the gear unit, and the pusher, thereby easily opening the refrigerator door with smaller force.

Also, separation of food from the inside of the refrigerator door, which may occur when the user suddenly opens the refrigerator door with strong force, is prevented, thereby improving user convenience.

Furthermore, the dampers are provided at the contact portions in the door handle and the contact portions between the door handle and the refrigerator door, thereby reducing noise and impact generated during opening and closing of the refrigerator door.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a refrigerator body;

a door to open and close a front of the refrigerator body; and a door handle provided at one side of the door, wherein the door handle comprises a handle unit having a grip part to allow a user to grip the door handle, a guide base and a handle case coupled to the guide base to fixedly couple the door handle to one side of the door;

an actuating rod fixed inside the handle unit such that the actuating rod is moved along with the handle unit;

a guide unit fixedly located at the guide base to guide movement of the actuating rod;

a gear unit, the gear unit comprising a gear shaft located at the guide base within the handle unit in a supported state, and gears fixed to opposite ends of the gear shaft such that the gears are simultaneously rotated with the gear shaft, the gears being provided at upper and lower portions of the handle unit, respectively; and a pusher configured to be advanced and retreated through movement relative to the actuating rod to push one side of the refrigerator body, the pusher having a toothed part engaging with the gears of the gear unit at only one of an upper or lower portion of the handle unit and moving according to forward movement of the handle unit, wherein the gear unit it disposed between the actuating rod and the pusher such that the gear unit is engaged with the actuating rod and the pusher.

2. The refrigerator according to claim 1, wherein the gears are coupled to the opposite ends of the gear shaft in a symmetric manner.

3. The refrigerator according to claim 1, wherein the gears comprise:

a first gear engaged with the actuating rod; and a second gear engaged with the pusher.

4. The refrigerator according to claim 1, wherein the actuating rod comprises:

at least one rod part fixed to the handle unit, the at least one rod part being disposed in the guide unit such that the at least one rod part is advanced and retreated in a frontward and rearward direction of the door; a toothed rod formed to be engaged with the gear unit in a protruding state; and a connection part to integrally interconnect the at least one rod part and the toothed rod.

5. The refrigerator according to claim 4, wherein the door handle further comprises an elastic member disposed between the guide unit and the at least one rod part while surrounding the at least one rod part to apply elastic force to the actuating rod.

6. The refrigerator according to claim 5, wherein the guide unit comprises a guide hole through which the at least one rod part is advanced and retreated.

7. The refrigerator according to claim 6, wherein the actuating rod further comprises a first damper coupled to one end of the at least one rod part.

8. The refrigerator according to claim 7, further comprising a second damper disposed between the handle unit and the guide unit, the second damper being fixed to an inside of the handle unit or an outside of the guide unit.

9. The refrigerator according to claim 1, wherein the guide base comprises a first guide groove to support the pusher such that the pusher is advanced and retreated in a frontward and rearward direction of the door.

10. The refrigerator according to claim 9, wherein the handle case comprises a second guide groove to support the pusher such that the pusher is advanced and retreated in the frontward and rearward direction of the door.

* * * * *

UNITED STATES PATENT AND TRADEMARK OFFICE

CERTIFICATE OF CORRECTION

PATENT NO. : 8,523,302 B2
APPLICATION NO. : 12/932819
DATED : September 3, 2013
INVENTOR(S) : Dong In Shin et al.

It is certified that error appears in the above-identified patent and that said Letters Patent is hereby corrected as shown below:

In the Claims

In Column 10, Line 34, In Claim 1, delete "it" and insert -- is --, therefor.

Signed and Sealed this
Eighteenth Day of February, 2014

Michelle K. Lee

Michelle K. Lee
*Deputy Director of the United States Patent and Trademark Office*